United States Patent [19]

Brouwer

[11] 4,337,707

[45] Jul. 6, 1982

[54] RAILWAY HOPPER CAR BOGIE

[75] Inventor: Cornelis Brouwer, Potchefstroom, South Africa

[73] Assignee: Rotaque (Proprietary) Limited, Potchefstroom, South Africa

[21] Appl. No.: 122,974

[22] Filed: Feb. 20, 1980

Related U.S. Application Data

[63] Continuation of Ser. No. 874,180, Feb. 1, 1978, abandoned, which is a continuation of Ser. No. 760,799, Jan. 19, 1977, abandoned.

[30] Foreign Application Priority Data

Jan. 28, 1976 [ZA] South Africa ..... 76/0485

[51] Int. Cl.[3] ..... B61D 7/04; B61F 5/04; B61F 5/14; B61F 5/52

[52] U.S. Cl. ..... 105/250; 105/176; 105/199 CB; 105/199 R; 105/241.2

[58] Field of Search ..... 105/4 R, 133, 165, 176, 105/199 F, 199 R, 218 A, 241.1, 199 CB, 241.2, 250

[56] References Cited

U.S. PATENT DOCUMENTS

| | | | |
|---|---|---|---|
| 204,009 | 5/1978 | Dabney et al. | 105/199 R |
| 431,936 | 7/1890 | Crow | 105/199 R |
| 538,858 | 5/1895 | Adams | 105/199 R X |
| 926,189 | 6/1909 | Howard | 105/133 |
| 1,184,023 | 5/1916 | Rohlfing | 105/176 |
| 1,331,887 | 2/1920 | Van Dyke, Jr. | 105/199 R X |
| 1,594,863 | 8/1926 | Warner | 105/241.1 X |

FOREIGN PATENT DOCUMENTS

| | | | |
|---|---|---|---|
| 536966 | 6/1941 | United Kingdom | 105/4 |
| 619140 | 3/1949 | United Kingdom | 105/218 A |
| 796922 | 6/1958 | United Kingdom | 105/165 |
| 832274 | 4/1960 | United Kingdom | 105/199 F |
| 1117539 | 6/1968 | United Kingdom | 105/199 R |
| 1194908 | 6/1970 | United Kingdom | 105/199 R |
| 1452569 | 10/1976 | United Kingdom | 105/199 R |

*Primary Examiner*—Joseph F. Peters, Jr.
*Assistant Examiner*—Howard Beltran
*Attorney, Agent, or Firm*—Pollock, Vande Sande & Priddy

[57] ABSTRACT

A rail vehicle is disclosed which includes a bottom discharge hopper supported on an elongated, rectangular base frame. A bogie frame is provided beneath the base frame at each end thereof, the bogie frames carrying the vehicle wheels. Each bogie frame comprises two laterally spaced longitudinal members and a transverse member. Bearings are provided between the bogie frame members and the longitudinal and transverse members of the rectangular base frame. These bearings comprise rolling elements in arcuate grooves, the grooves being generated about the vertical pivotal axis of the adjacent bogie frame. Pins are provided which extend downwardly from the base frame and through arcuate slots in the bogie frames. The pins have structures at their lower ends for preventing upward withdrawal thereof through said slots. The slots are generated about the pivotal axis of the adjacent bogie frame.

18 Claims, 8 Drawing Figures

RAILWAY HOPPER CAR BOGIE

This application is a continuation of U.S. patent application Ser. No. 874,180, filed Feb. 1, 1978, now abandoned, which is a continuation of U.S. patent application Ser. No. 760,799, filed Jan. 19, 1977, now abandoned.

This invention relates to rail vehicles.

According to the present invention there is provided a rail vehicle comprising a base frame supporting the vehicle body, a bogie frame on which wheels of the vehicle are mounted, bearing structures between the base frame and bogie frame and forming the means which support the base frame on the bogie frame, the bearing structures being spaced horizontally from the vertical axis about which the frames can perform relative pivoting motion, and means for limiting pivoting motion of said frames relatively to one another about said axis.

In a preferred form, the bogie frame is of U-shape in plan and comprises two spaced side members joined by a transverse member, there being a bearing structure between each side member and said base frame, and a further bearing structure between said transverse member and said base frame. The base frame can be of elongated, rectangular form and there can be a bogie frame beneath each end of the base frame. Each bearing structure can comprise a downwardly facing pressure plate on said base frame, and an upwardly facing pressure plate on said bogie frame with suitable lubrication provision as necessary. However, it is preferred that each bearing structure comprise a plurality of rolling elements. In a specific form each bearing structure comprises a downwardly open arcuate groove and an upwardly open arcuate groove, said grooves registering with one another, and said rolling elements being located in the registering grooves.

To provide positive relative location of the frames with respect to one another, one of said frames can have an arcuate slot therein, and the other of said frames can include a pin which projects into said slot, said slot being concentric with said axis and the pin and slot constituting the means for limiting pivoting motion of said frames relatively to one another about said axis. Preferably, said slot is provided in the bogie frame and said pin projects downwardly into said slot from the base frame. In this form, said pin can project downwardly through said slot and means can be provided on the lower end of said pin for preventing upward withdrawal of the pin from the slot. Desirably, a plurality of arcuate slots and pins are provided, each slot being concentric with said axis.

The number of arcuate slots can equal the number of pairs of registering grooves, and each slot can be positioned radially with respect to a pair of registering grooves. In one constructional form, some of said slots are positioned radially inwardly of the pairs of registering grooves, and others are positioned radially outwardly of said pairs of registering grooves. In another form, each slot lies radially outwardly of an associated pair of registering grooves.

For a better understanding of the present invention, reference will now be made to the accompanying drawings which illustrate the invention by way of example and in which.

Figure 1:
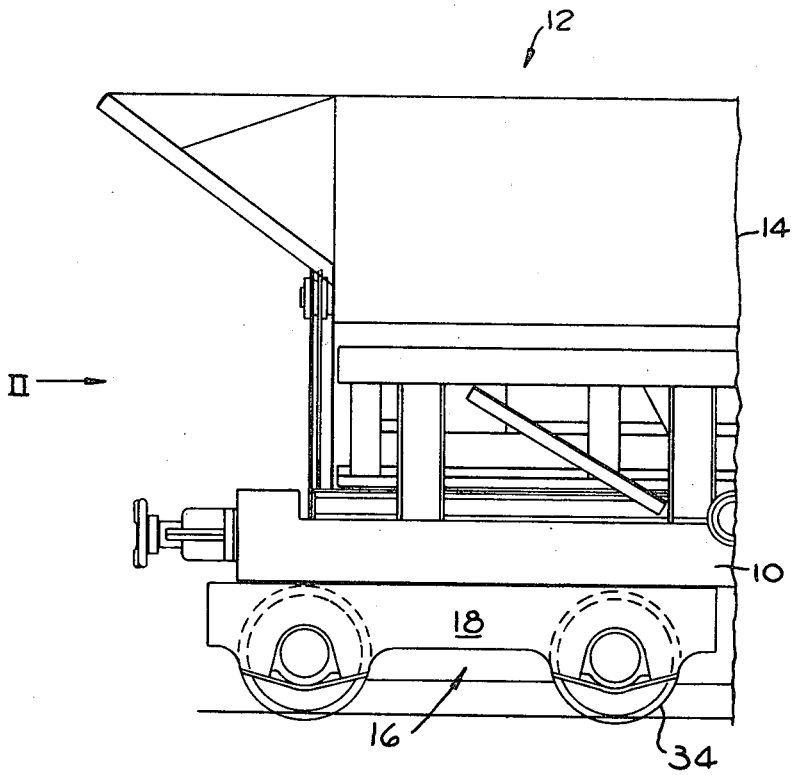
FIG. 1 is a side elevation of one end of a rail vehicle according to the invention.
Figure 2:
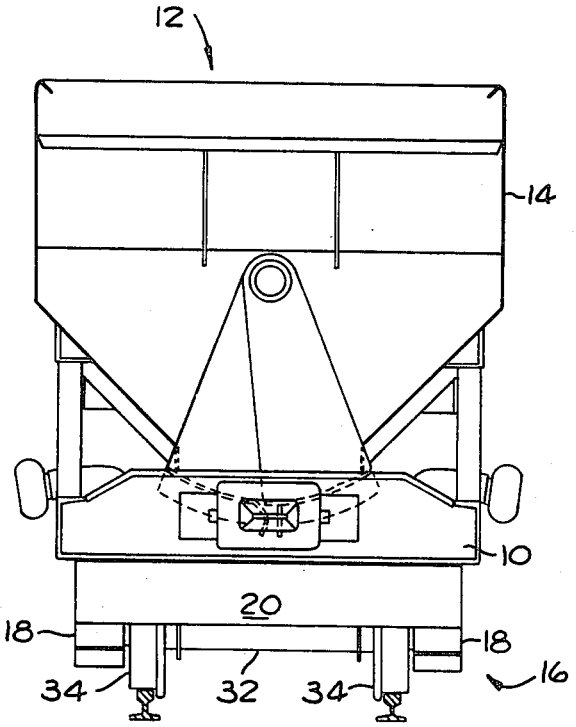
FIG. 2 is an end view taken in the direction of the arrow II in FIG. 1.

In FIGS. 1 and 2 reference numeral 10 denotes the base frame of a hopper rail vehicle 12 and on which is mounted a bottom discharge hopper 14 which extends substantially the full length of the frame 10. The hopper 14 is arranged to discharge gravitationally through the frame 10 which provides an unobstructed opening extending the full length of the frame. Rail vehicles of this type are used to transport ore, coal, etc.

Each end portion of the frame 10 is supported on a bogie 16. Each bogie 16 comprises a rigid bogie frame which is of substantially U-shape in plan (see for example FIG. 3) and comprises two parallel, spaced side members 18 and a transverse member 20. Each bogie 16 presents a planar upper face.

A plate 22 is mounted on the upper face of the center portion of each side member 18. Each plate 22 has an arcuate groove 24 therein and is secured to the underlying member 18 by means such as bolts and nuts. A further grooved plate 22 is provided on an inwardly projecting portion 26 of the transverse member 20. Adjacent each grooved plate 22 an arcuate slot 28 is provided in the members 18 and 20. The grooves 24 of the plates 22 and the slots 28 formed in the bogie frame members are all centered on a center point 30 which coincides with the required vertical pivoting axis of the bogie 16.

The side members 18 mount bearings for wheel axles 32 which in turn carry flanged wheels 34.

Figure 4:
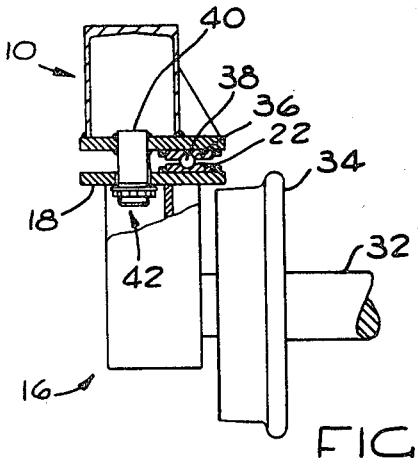
FIG. 4 is a section on the line IV—IV of FIG. 3, drawn to a larger scale.

At positions on the end portion of the base frame 10 corresponding to the positions of the plates 22, similar, but inverted, grooved plates 36 (see FIG. 4) are provided for location over the plates 22 of the bogie 16. In the grooves 24 of the plates 22 on the bogie, hard metallic balls 38 are received. These balls 38 enter the grooves of the base frame plates 36 when the frame 10 is placed over the bogie 16 thereby to support the base frame 10 on the bogie 16. The balls 38 permit relative pivoting movement of the bogie and base frame about the vertical axis passing through the center point 30. While balls 38 are preferred, rollers can be used.

The slots 28 of the bogie frame members are entered from above by pins 40 (see FIG. 4) fixed to and extending downwardly from the base frame 10. The pins 40 each project downwardly through the associated slot 28 and receive a nut and washer arrangement 42 on the lower end thereof to prevent unintentional upward retraction of the pins from the slots. Rotatable sleeves (not shown) or other means for reducing wear can be provided on the pins 40.

Figure 3:
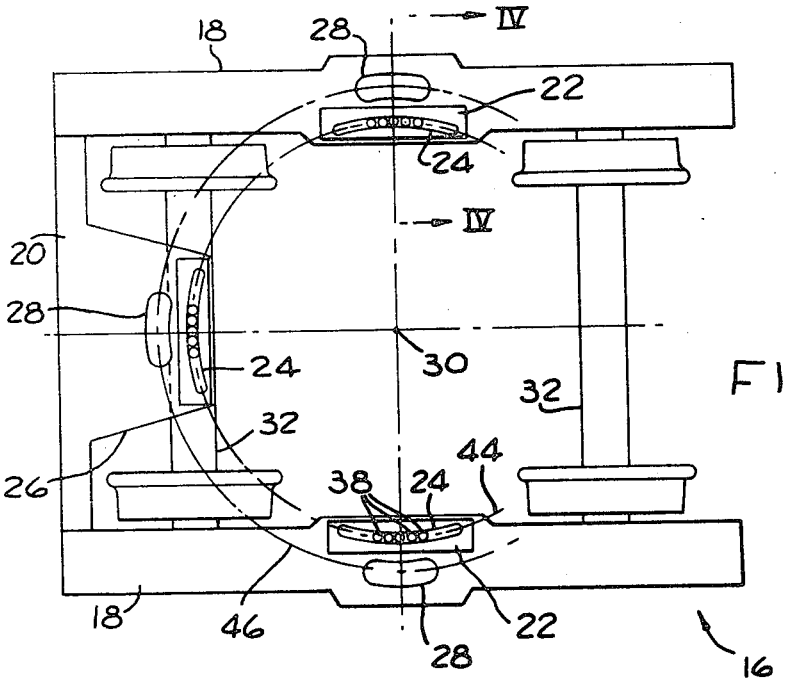
FIG. 3 is a plan view of one of the bogies of the rail car of FIGS. 1 and 2.

The three grooves 24, and consequently also the balls 38, are arranged, in the embodiment of FIG. 3, on a common pitch circle 44, while the slots 28 are all arranged on a common, larger diameter pitch circle 46. According to the modified arrangement of FIG. 5, the grooves 24 and the balls 38 of the plates 22 on the side members 18 are located on an inner pitch circle 48. The groove 24 and balls 38 on the transverse member 20 of the bogie are on a larger radius pitch circle 50. All the slots 28 in this form are on a common pitch circle 52 which lies between the circles 48 and 50.

Figure 6:
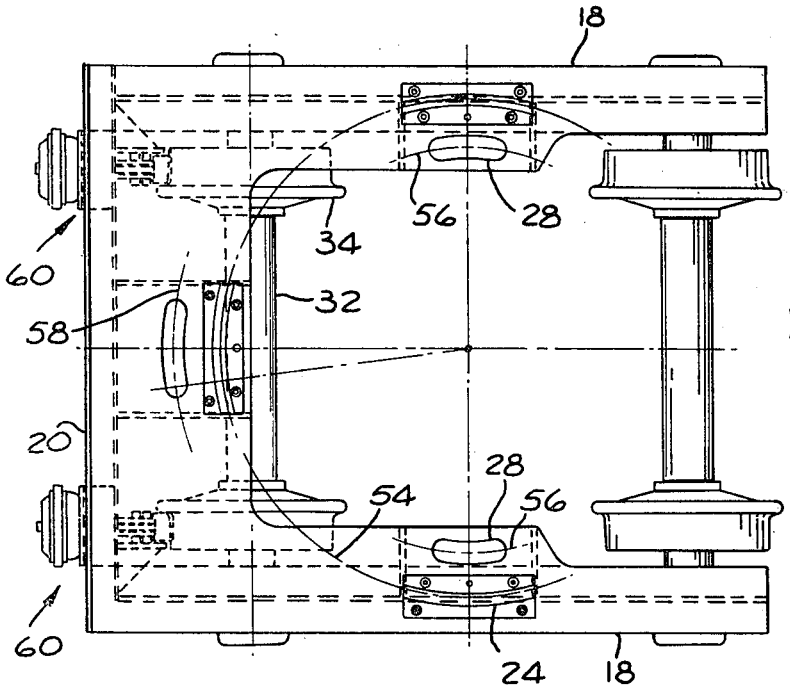
FIG. 6 is a view similar to that of FIGS. 3 and 5 shows a further modified form.
Figure 8:
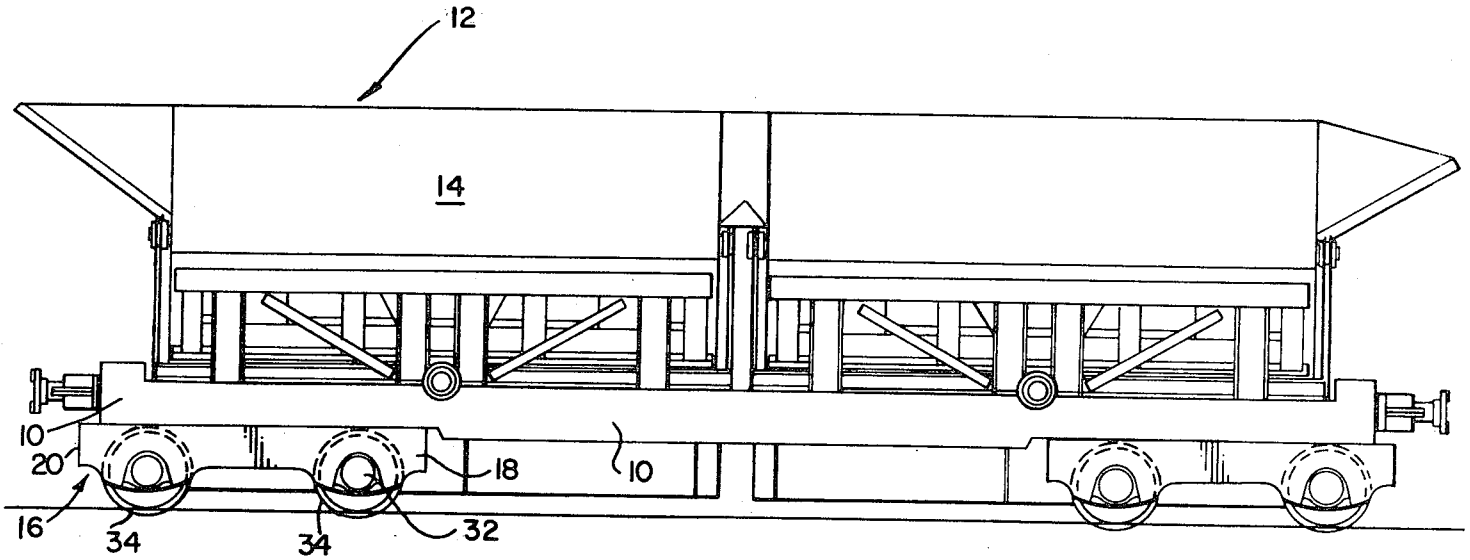
FIG. 8 is a side elevation similar to FIG. 1, showing the entire rail vehicle.

According to the modification of FIG. 6, the grooves 24 and the balls 38 are all on a common pitch circle 54. The slots 28 in the side members 18 of the bogie 16 are on a common pitch circle 56 whereas the slot 28 in the transverse member of the bogie is on an outer pitch circle 58.

It will be understood that the plates 36 and the pins 40 of the base frame 10 are arrangd on corresponding pitch diameters.

In FIG. 6 pneumatic cylinders 60 for operating the brakes of the wheels 34 are shown.

Figure 7:
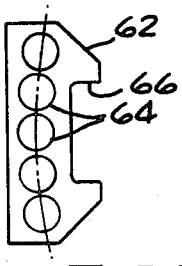
FIG. 7 is a plan view of a ball retainer.

To assure that the balls 38 are maintained at the desired spacing, a retainer or cage, as shown in FIG. 7, is employed in conjunction with each set of balls.

The retainer comprises a thin metallic plate 62 (FIG. 7) having closely spaced holes 64 in each of which a ball 38 is located. In one side of the plate a wide notch 66 is provided which receives a stub pin (not shown) protruding upwardly from the bottom plate 22. The stub pin permits only limited movement of such retainer. The retainer is located with small clearance between a co-acting pair of grooved plates 22 and 36. By limiting the freedom of movement of the retainer, the balls can be retained in the central region of the slots in which they roll.

In operation, on swivelling of the bogie relative to the base frame, the base frame rides on the balls 38. The extent of swivelling is limited by the effective length of the slots 28.

If desired, the thickness of the pin 40 engaging the slot 28 in the transverse member 20 of the bogie may be larger than the other pins, as this pin can be subjected to greater forces during running of the vehicle.

Figure 5:
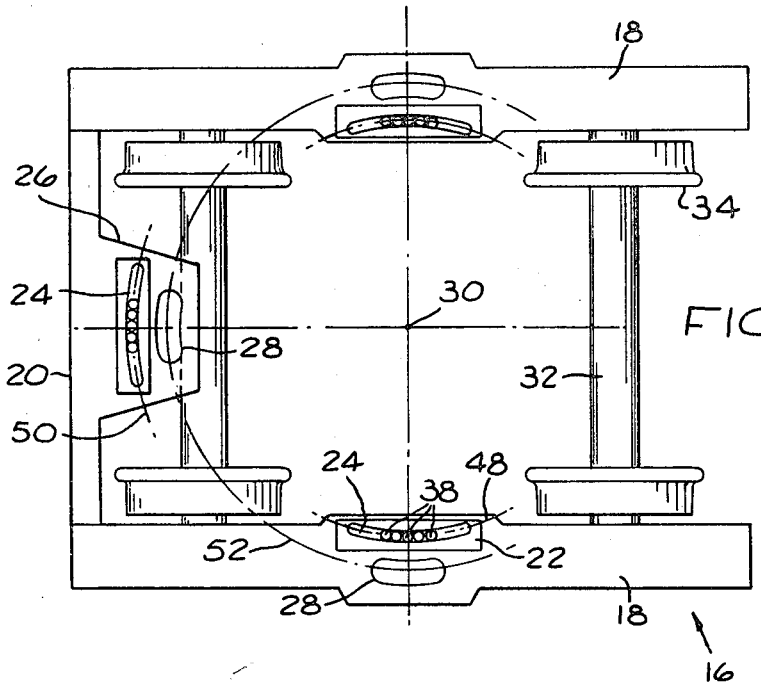
FIG. 5 is a view similar to that of FIG. 3 and shows a modified arrangement.

The only obstruction to discharge of the hopper load is the axle of the innermost pair of wheels of each bogie, i.e., the right-hand pair in each of FIGS. 3, 5 and 6. The said pairs of wheels are fixed to the respective axles in order that a live axle is presented which, due to its rotary movement, prevents material from packing thereon.

I claim:

1. A wheeled rail vehicle comprising (a) a base frame which is of elongated rectangular form in plan view;

(b) a hopper supported on said base frame, said hopper having a discharge opening at the bottom thereof which opening is elongated in the direction of elongation of said base frame, which extends continuously over substantially the entire length of said frame, and which is arranged so that the load carried in said hopper, upon being discharged, falls through said base frame;

(c) a pair of bogie frames on which wheels of said vehicle are mounted, said bogie frames being located beneath opposite ends of said base frame, each bogie frame being U-shaped in plan view and comprising two spaced side members joined by a transverse member, said side members of each bogie frame extending away from said transverse member of that bogie frame towards the center of said vehicle;

(d) bearing structures between said base frame and each bogie frame and forming means which support said base frame on said bogie frames and permit relative pivoting movement between the base frame and the bogie frames about respective vertical axes, said bearing structures being radially spaced horizontally from the respective vertical axes about which said bogie frames and base frame can perform relative pivoting motion; and (e) means for limiting pivoting motion and separation of said bogie frames and base frame relatively to one another about said axes.

2. A wheeled rail vehicle as claimed in claim 1, wherein a plurality of arcuate slots and pins are provided, each slot being concentric with one of said axes.

3. A wheeled rail vehicle as claimed in claim 1, wherein said base frame has a pair of arcuate slots therein and each bogie frame includes a pin which projects into one of the slots of the base frame, said slots each being concentric with one of said axes and the pins and slots constituting the means for limiting pivoting motion of said frames relatively to one another about said axes.

4. A wheeled rail vehicle as claimed in claim 1, wherein each bogie frame has an arcuate slot therein and the base frame includes two pins which project into the slots of the bogie frames, said slots each being concentric with one of said axes and the pins and slots constituting the means for limiting pivoting motion of said frames relatively to one another about said axes.

5. A wheeled rail vehicle as claimed in claim 1, wherein there is a bearing structure between each said side member and said base frame, and a further bearing structure between the central region of each transverse member and said base frame.

6. A wheeled rail vehicle as claimed in claim 1, wherein each bearing structure comprises a downwardly facing pressure plate on said base frame, and an upwardly facing pressure plate on said bogie frame.

7. A wheeled rail vehicle as claimed in claim 1, in which each bearing structure comprises a plurality of rolling elements.

8. A wheeled rail vehicle as claimed in claim 7, wherein said elements are balls.

9. A wheeled rail vehicle as claimed in claim 7, wherein each bearing structure comprises a downwardly open arcuate groove and an upwardly open arcuate groove, said grooves registering with one another, and said rolling elements being located in the registering grooves.

10. A wheeled rail vehicle as claimed in claim 9, wherein said groove are formed in plates secured to the underside of said base frame and to the top face of said bogie frame.

11. A wheeled rail vehicle as claimed in claim 9, wherein a cage having apertures for receiving the rolling elements is provided between said registering grooves, there being means for limiting movement of said cage in the direction of elongation of said grooves.

12. A wheeled rail vehicle as claimed in claim 1, wherein said limiting means constituting slots are provided in said bogie frames and pins project downwardly into said slots from said base frame.

13. A wheeled rail vehicle as claimed in claim 12, wherein said pins project downwardly through said slots and means are provided on the lower ends of said pins for prevention upward withdrawal of the pins from the slots.

14. A wheeled rail vehicle comprising (a) a base frame which is of elongated rectangular form in plan view;

(b) a hopper supported on said base frame, said hopper having a discharge opening at the bottom thereof which opening is elongated in the direction of elongation of said base frame, which extends continuously over substantially the entire length of said frame, and which is arranged so that the load carried in said hopper, upon being discharged, falls through said base frame;

(c) a pair of bogie frames on which wheels of said vehicle are mounted, said bogie frames being located beneath opposite ends of said base frame, each bogie frame being capable of pivotal movement with respect to said base frame about a respective vertical axis, and each bogie frame being U-shaped in plan view and comprising two spaced side members joined by a transverse member, the side members of each bogie frame extending away from said transverse member of that bogie frame towards the center of said vehicle;

(d) bearing structures between said base frame and said bogie frames and forming means for supporting said base frame on said bogie frames, each bearing structure comprising portions of said base frame defining a downwardly open arcuate groove and portions of said bogie frames defining upwardly open arcuate groove and portions of said bogie frames defining upwardly open arcuate grooves, each downwardly open groove registering with one of the upwardly open grooves and the grooves being generated about, and radially spaced horizontally from said respective vertical axes about which said bogie frames and base frame can perform relative pivoting motion;

(e) rolling elements received in said pairs of registering grooves; and (f) a plurality of arcuate slots in one of said bogie and base frames, a plurality of pins projecting from the other of said bogie and base frames, and each pin entering a respective one of said slots to prevent separation, each of said slots being concentric with one of said respective axes and the number of arcuate slots being equal to the number of pairs of registering grooves, each slot being positioned radially with respect to a pair of registering grooves.

15. A wheeled rail vehicle as claimed in claim 14, wherein some of said slots are positioned radially inwardly of the pairs of registering grooves, and others are positioned radially outwardly of said pairs of registering grooves.

16. A wheeled rail vehicle as claimed in claim 14, wherein each slot lies radially outwardly of an associated pair of registering grooves.

17. In a rail vehicle comprising a base frame and a hopper supported on said base frame, said hopper having a discharge opening at the bottom thereof which opening (1) is elongated in the direction of elongation of said base frame, (2) extends over substantially the entire length of said frame, and (3) is arranged so that a load carried in said hopper, upon being discharged, falls through said base frame, the improvement comprising (a) a bogie frame located beneath an end of said base frame to move pivotally with respect to said base frame about a vertical axis;

(b) a bearing structure between said base frame and said bogie frame for supporting said base frame on said bogie frame;

(c) said bearing structure comprising mutually facing grooves in said base frame and said bogie frame, respectively, said grooves being generated about and spaced horizontally from said vertical axis, and having rolling elements therein;

(d) a plurality of arcuate slots in one of said bogie and base frames, and a plurality of pins projecting from the other of said frames and each entering one of said slots, said slots being substantially concentric with said vertical axis, and each slot being positioned radially with respect to a pair of mutually facing grooves; and (e) means for limiting the vertical motion of said pins with respect to said slots, and thereby the vertical distance between said mutually facing grooves to prevent separation of the base frame and bogie frame.

18. A wheeled rail vehicle comprising (a) a base frame which is of elongated rectangular form in plan view;

(b) a hopper supported on said base frame, said hopper having a discharge opening at the bottom thereof which opening is elongated in the direction of elongation of said base frame, which extends continuously over substantially the entire length of said frame, and which is arranged so that the load carried in said hopper, upon being discharged, falls through said base frame;

(c) a pair of bogie frames on which wheels of said vehicle are mounted, said bogie frames being located beneath opposite ends of said base frame, each bogie frame being U-shaped in plan view and comprising two spaced side members joined by a transverse member, said side members of each bogie frame extending away from said transverse member of that bogie frame towards the center of said vehicle;

(d) bearing structures between said base frame and each bogie frame and forming means which support said base frame on said bogie frames, and permit relative pivoting movement between the base frame and the bogie frames about respective vertical axes, said bearing structures being spaced horizontally from the vertical axes about which said bogie frames and base frame can perform relative pivoting motion; and (e) means for limiting pivoting motion of said bogie frames and base frame relatively to one another about said axes, said means comprising slots in said bogie frames and pins projecting downwardly through said slots from said base frame, means being provided on the lower ends of said pins for preventing upward withdrawal of said pins from said slots.

* * * * *